US006523774B2

(12) United States Patent
Lenz et al.

(10) Patent No.: US 6,523,774 B2
(45) Date of Patent: Feb. 25, 2003

(54) METHOD AND APPARATUS FOR WINDING A CONTINUOUSLY ADVANCING YARN

(75) Inventors: Friedhelm Lenz, Wuppertal (DE); Reinhard Lieber, Sprockhövel (DE)

(73) Assignee: Barmag AG, Remscheid (DE)

( * ) Notice: Subject to any disclaimer, the term of this patent is extended or adjusted under 35 U.S.C. 154(b) by 0 days.

(21) Appl. No.: 10/003,745

(22) Filed: Oct. 31, 2001

(65) Prior Publication Data

US 2002/0043585 A1 Apr. 18, 2002

Related U.S. Application Data

(63) Continuation of application No. PCT/EP00/03951, filed on May 3, 2000.

(30) Foreign Application Priority Data

May 6, 1999 (DE) ..... 199 20 856

(51) Int. Cl.[7] ..... B65H 54/32

(52) U.S. Cl. ..... 242/480.4; 242/481.4; 242/477.2

(58) Field of Search ..... 242/480.4, 481.4, 242/477.1, 477.2

(56) References Cited

U.S. PATENT DOCUMENTS 3,876,166 A * 4/1975 Kadokura et al. ..... 242/480.4
4,325,517 A * 4/1982 Schippers et al. ..... 242/477.2
4,462,558 A * 7/1984 Stahlecker et al. .. 242/480.4 X
4,659,027 A * 4/1987 Schippers et al. ..... 242/477.5
4,913,363 A 4/1990 Lenz
6,065,712 A * 5/2000 Mayer et al. ..... 242/477.2
6,283,401 B1 * 9/2001 Lieber et al. ..... 242/477.2

FOREIGN PATENT DOCUMENTS

| | | |
|---|---|---|
| DE | 35 05 453 A1 | 5/1986 |
| DE | 37 23 524 A1 | 2/1988 |
| DE | 198 07 030 A1 | 9/1998 |
| EP | 0 235 557 B1 | 9/1987 |

* cited by examiner

*Primary Examiner*—Kathy Matecki
*Assistant Examiner*—Minh-Chau Pham
(74) *Attorney, Agent, or Firm*—Alston & Bird LLP

(57) ABSTRACT

A method and apparatus for winding a continuously advancing yarn, wherein the yarn is wound on a driven tube to a cross wound package. The yarn is reciprocated by means of a traversing yarn guide within a traverse stroke which is variable in its length within the package width of the cross wound package. During the winding cycle, the traverse stroke is varied between a maximum length at the beginning of the winding cycle and an end length at the end of the winding cycle by a predetermined stroke function in such a manner that in the course of the winding cycle, a certain length is associated to each traverse stroke, with the lengths of the traverse strokes being smaller than the respective wound package widths then being formed.

19 Claims, 3 Drawing Sheets

METHOD AND APPARATUS FOR WINDING A CONTINUOUSLY ADVANCING YARN

CROSS REFERENCE TO RELATED APPLICATION

This is a continuation of PCT/EP00/03951, filed May 3, 2000, and designating the U.S.

BACKGROUND OF THE INVENTION

The invention relates to a method and apparatus for winding a continuously advancing yarn to form a cross wound package.

In such a winding operation, the yarn is deposited at a crossing angle on the package surface within the package width at a substantially constant circumferential speed of the package. To this end, the yarn is reciprocated within a traverse stroke by a traversing yarn guide, before advancing onto the package surface. In this process, the length of the traverse stroke defines the package width.

A distinction can be made between two known methods of winding a package. In a first method, the traverse stroke is not varied in its maximum length during the winding cycle. With that, a cylindrical cross wound package is wound with substantially rectangular end faces. In so doing, the length of traverse stroke at the beginning of the winding cycle equals the length of the traverse stroke at the end of the winding cycle.

In the second method, the traverse stroke is constantly shortened during the winding cycle. In this instance, a cylindrical cross wound package is wound with oblique end faces. These so-called biconical packages thus slope relative to a normal plane, with the angle of slope being smaller than 90°. The traverse stroke at the end of the winding cycle has a length which is smaller than the length of the traverse stroke at the beginning of the, winding cycle.

Irrespective of which shape the end face of the package has, it is necessary to deposit the yarn layers at the ends of the package in such a manner that no irregularities develop by, for example, separating yarn lengths, such as the so-called yarn sloughs or slipping yarn layers. To this end, EP 0 235 557 and corresponding U.S. Pat. No. 4,913,363, propose to shorten and lengthen the traverse stroke cyclically during the winding cycle. This method is known as the so-called stroke modification. It permits producing a uniform mass distribution at the package edges, so that no beads form. Thus, while forming a straight end face, the length of the traverse stroke, which has been adjusted before the stroke modification, is again adjusted, after each modified stroke cycle. While winding a biconical package, a shortening of the basic traverse stroke defining the angle of slope, is adjusted after the modified stroke cycle.

DE 37 23 524 discloses a process wherein the end faces of a package are wound such that at the beginning of the winding cycle, a basic layer, which is wound at a smaller angle of slope, is initially built up. Subsequently, the winding cycle continues with a lesser shortening of the traverse stroke.

In practice, it has shown in the case of winding in particular textured yarns with a high crimp that, in particular in the center region of the package, beadlike bulges form at the end faces, which give rise to breakdowns at high unwinding speeds in the further processing.

It is therefore an object of the invention to provide a process of the initially described kind, as well as an apparatus for carrying out the method, which permits winding a cross wound package with substantially straight line end faces.

SUMMARY OF THE INVENTION

The invention distinguishes itself in that all overlying yarn layers of a cross wound package are included in the shaping of the end faces. The invention departs from the assumption that for producing a rectangular or a sloped end face of the package during the winding, the traverse stroke should be varied proportionately to the package width during the winding cycle. It has been found that the formation of the end face of the cross wound package is determined not only by the lengths of the traverse stroke, which are adjusted during the winding, but also results, after completion of the package, from the interaction of all overlying yarn layers. In this process, variations are found in particular in the intermediate diameter range of the package.

Such shape variations are taken into account by the method of the present invention, in that the lengths of the traverse stroke are varied during the winding cycle by a predetermined stroke function. The stroke function indicates the relationship between the winding, which may be defined by the winding time or the package diameter, and the lengths of the traverse stroke that are to be adjusted each time. In so doing, a certain length is associated in the course of the winding cycle to each traverse stroke by the stroke function, with the lengths of the traverse strokes being smaller than the respectively wound package widths. Thus, one may also consider the stroke function as a measure, which indicates the difference between the length of the traverse stroke and the final package width at the package diameter then being wound.

Especially advantageous for forming straight line end faces is a stroke function, in which a constant shortening of the traverse stroke relative to the package width is predetermined at the beginning of the winding cycle, and a constant lengthening of the traverse stroke relative to the package width is predetermined at the end of the winding cycle. Thus, the greatest deviations between the package width and the length of the traverse stroke result in the intermediate range.

The traverse stroke variations as are predetermined by the stroke function during the winding cycle are essentially dependent on one or more parameters, such as yarn tension, crimp of the yarn, yarn denier, package density, and yarn deposit, which is defined by the crossing angle and the yarn reversal. Thus, the relationship was found that, for example, a textured yarn with a relatively low crimp requires a stroke function which shows a greater deviation between the package width and the length of the traverse stroke in the intermediate range of the package. In comparison therewith, the winding of a package with a very high package density requires only a small deviation between the package width and the length of the traverse stroke.

In a particularly advantageous further development of the invention, a certain length of the traverse stroke is associated to each package diameter wound during the winding cycle. This permits producing and reproducing a very accurate geometrical form of the cross wound package.

In the case of cross wound packages, which are not subject to a preferred yarn guidance in the further processing, a variant of the method is advantageous wherein the stroke function effects on the end faces of the cross wound package a symmetrical shortening and a symmetrical lengthening of the traverse stroke. In this variant, both end faces of the cross wound packages are uniformly wound by the stroke function.

To facilitate as much as possible satisfactory unwinding properties of the yarn from a package being unwound overhead in a further processing step, it is preferred to use a variant wherein the stroke function effects an asymmetrical shortening and an asymmetrical lengthening of the traverse stroke. Thus both end faces maybe differently wound in their shaping.

Since a stroke function proceeds respectively from a maximum length of the traverse stroke adjusted at the beginning of the winding cycle and an end length of the traverse stroke adjusted at the end of the winding cycle, the stroke function is predetermined for an end diameter or an angle of slope. In particular, in the production of biconical packages, it will therefore be of advantage, when respectively one stroke function resulting in a certain angle of slope on at least one end face of the cross wound package, is associated to each wound end diameter of a c[]ross wound package.

Likewise, in the winding of biconical packages, a variation of the angle of slope results in that the end length of the traverse stroke must be varied at the same time. To this end, it is especially advantageous to use a variant of the method wherein respectively one stroke function is associated to each angle of slope of the cross wound package. Each of the stroke functions is directed to a certain end diameter of the cross wound package.

In the winding of cross wound packages with an end face having an angle of 90°, the maximum length of the traverse stroke at the beginning of the winding cycle and the end length of the traverse stroke at the end of the winding cycle are each predetermined of an identical size. Contrary thereto, it is possible to adjust any desired angle of slope on the end face of the package by shortening the end length of the traverse stroke.

In a particularly advantageous variant of the method, the stroke function is input and stored in a controller. The controller connects to the drive of the traversing yarn guide, thereby influencing the traversing movement and the traverse stroke of the traversing yarn guide. For example, the stroke function could lead by means of a time program in the controller to a continuous and discontinuous variation of the traverse stroke.

To obtain an as precise as possible buildup of the package, a variant of the method is advantageous wherein the actual diameter of the package is continuously determined from the rotational speed of the package and the winding speed, so that the controller controls the drive with the length of the traverse stroke that is predetermined for the instantaneous package diameter.

The method of present invention is independent of the type of wind. The types of wind include random wind, precision wind, or stepped precision wind. In the case of the random wind, the mean value of the traversing speed remains substantially constant during the winding cycle. In this process, the wind ratio (spindle speed/traversing speed) varies continuously. In a precision wind, the wind ratio is kept constant. In a stepped precision wind, however, the wind ratio is varied in steps according to a predetermined program.

It is likewise very advantageous to combine the method of the present invention with the known ribbon breaking methods or with known stroke modification methods. With that, it is possible to produce cross wound packages with a large diameter and a great package length, which ensure a trouble free overhead unwinding of the yarn at high unwinding speeds of far above 1000 m/min.

The device of the present invention for carrying out the method distinguishes itself by a high flexibility in the production of packages. With its use it is easy to vary both the angles of slope in the case of biconical packages, and the end diameter of the packages.

When predetermining the traverse stroke, the controller proceeds each time from the instantaneous actual diameter of the package. To this end, the controller connects to a sensor that measures the rotational speed of the tube. One or more stroke functions are stored in a data storage. Likewise, the winding speed is stored as a known variable in the controller. By means of a computing unit, it is thus a possible to determine the instantaneous package diameter from the rotational speed of the tube and the winding speed. The stroke function, which associates with reference to a table of values, to each package diameter a certain, process optimized length of the traverse stroke, permits determining the length of the traverse stroke that is to be adjusted. With that, the drive of the traversing yarn guide is controlled with an optimal traverse stroke via the controller at any time of the winding cycle.

The flexibility of the device is further increased by the very advantageous embodiment of the invention wherein the traversing yarn guide is driven by means of a motor, in particular a stepping motor. With that, there exists the possibility of coupling the traversing speed with the respective length variation of the traverse stroke. A shortening of the traverse stroke can thus occur at a constant traversing speed or at a constantly deposited amount of yarn per unit time.

The coupling between the traversing yarn guide and the motor is advantageously provided in the form of a belt drive. To this end, the motor includes a drive pulley, which drives a belt extending over at least one belt pulley. The belt mounts the traversing yarn guide, and reciprocates it within the package width.

To obtain a uniform winding speed, it is advantageous to drive the tube or package by a drive roll in circumferential contact with the tube or the package. To this end, the tube is clamped in a package holder between two centering plates, with the sensor for measuring the rotational speed of the tube being arranged on the package holder.

In this connection, it will be especially advantageous, when the sensor is designed and constructed as a pulse transmitter. The pulse thus signals one revolution of the rotational speed as well as a zero position of the package. However, it is also possible to provide a plurality of markings on one of the centering plates, so that a plurality of pulses are signaled per revolution.

A further embodiment of the invention provides for the sensor signal to indicate not only the rotational speed of the package, but also the angular position of the package. This makes it possible to distribute the yarn reversal in the individual yarn layers evenly over the circumference of the package.

BRIEF DESCRIPTION OF THE DRAWINGS

In the following, both the method and the apparatus for carrying out the method are described in greater detail by means of several embodiments with reference to the attached drawings, in which.

DETAILED DESCRIPTION OF THE PREFERRED EMBODIMENTS

Figure 1:
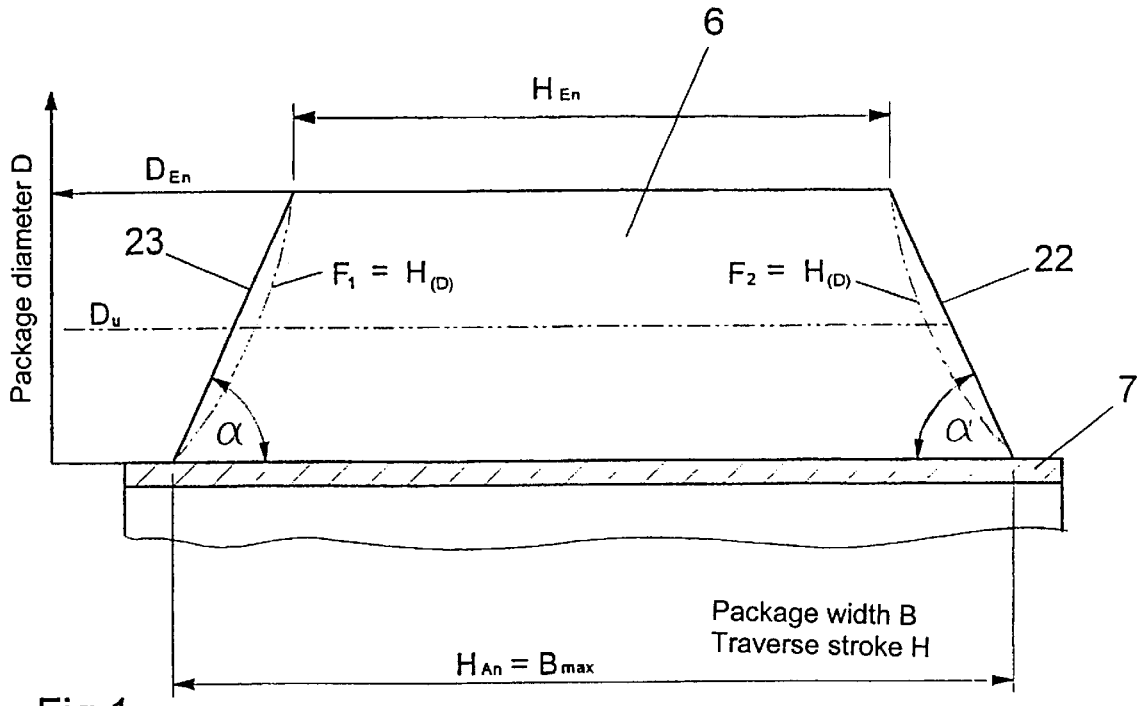
FIG. 1 is a schematic sectional view of half of a fully wound biconical cross wound package.

FIG. 1 is a schematic sectional view of half of a biconically wound cross wound package. The cross wound package 6 is wound on a tube 7. On the tube surface, the package has a maximum width $B_{max}$. In the illustration of FIG. 1, the package diameter is plotted on an ordinate. The cross wound package has an end diameter $D_{En}$. The end faces 22 and 23 are each made oblique at an angle of slope $\alpha$. To this end, the traverse stroke was wound at the beginning of the winding cycle at a maximum length $H_{An}$. The maximum length of the traverse stroke corresponds to the maximum package width on the surface of tube 7.

At the end of the winding cycle, the traverse stroke is adjusted to a shortened length $H_{En}$. The end length $H_{En}$ of the traverse stroke as well as the maximum length $H_{An}$ of the traverse stroke define the angle of slope $\alpha$. To obtain a straight line end face 23, the traverse stroke was varied during the winding cycle in its length H by a predetermined stroke function $F_1$. The stroke function $F_1$ is shown in FIG. 1 in phantom lines next to end face 23. The course of the stroke function over the package diameter shows a deviation from the final package width. At the beginning of the winding cycle the length of the traverse stroke H is reduced. Upon reaching a package diameter $D_u$, no further reduction of the traverse stroke occurs.

After winding the package diameter Du by the stroke function $F_1$, the traverse stroke is continuously lengthened by the function $F_1$, so that at the end of the winding cycle, the end length $H_{En}$ of the traverse stroke is adjusted at the end diameter of the package. Thus, at the end of the winding cycle, the package wound by the stroke function $F_1$ ends up with the end face 23 shown in solid lines in FIG. 1. With that, a bulging as it occurs in a package is purposely influenced, so that a straight line end face is obtained.

At the opposite end of the package, a yarn reversal occurs during the winding cycle by the stroke function $F_2$. The stroke function $F_2$ is identical with the stroke function $F_1$, so that the traverse stroke is uniformly shortened and lengthened at both package ends. The end face 22 is thus made symmetrical with the end face 23.

In this instance, the stroke function $F_1$ represents the dependency of the traverse stroke from the package diameter. Thus, a certain length of the traverse stroke is associated to each package diameter during the winding cycle. However, it is also possible to indicate the stroke function as a function of the winding time. In this case, a certain traverse stroke length would be associated to each instant of the winding.

Figure 2:
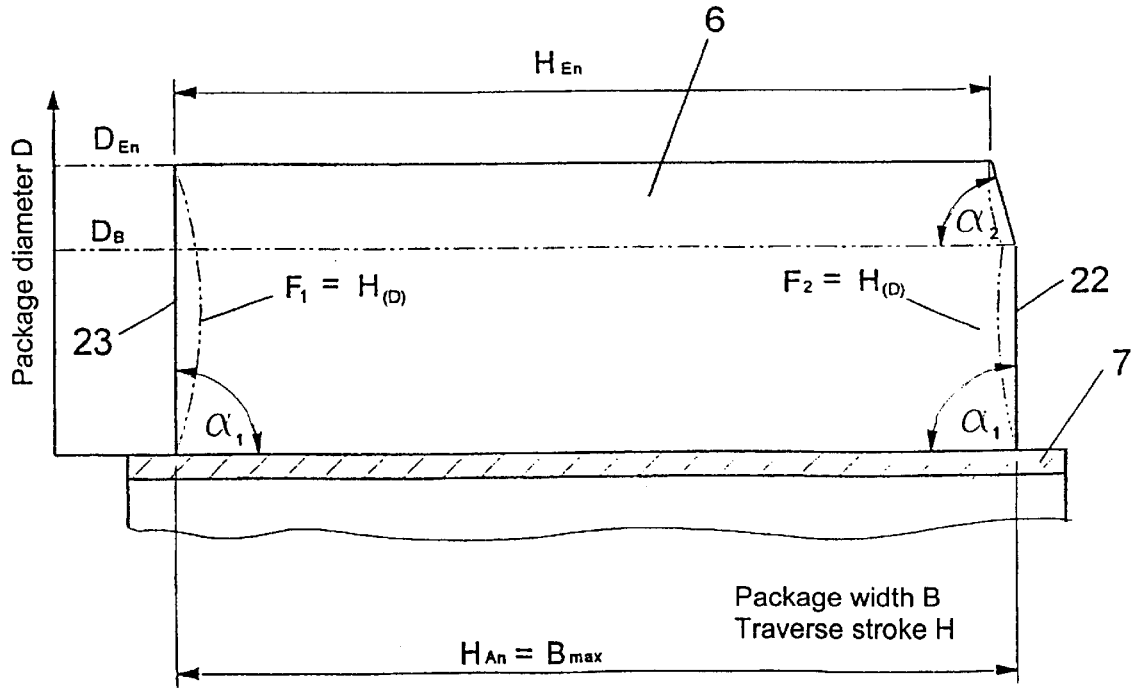
FIG. 2 is a schematic sectional view of half of a cross wound package with rectangular end faces.

FIG. 2 is a sectional view of half of a further embodiment of a wound package. The package 6 is wound on the tube 7. Plotted on the ordinate, at a right angle with the tube surface, is package diameter D. Once fully wound, the package 6 has an end diameter $D_{En}$. In this embodiment, the package 6 has two differently shaped, lateral surfaces 23 and 22. The lateral surface 23 is made rectangular with an angle of slope $\alpha_1$=90°. At the beginning of the winding cycle, the opposite lateral surface 22 is likewise wound at an angle of slope of $\alpha_1$=90°. Shortly before the end of the winding cycle, at package diameter $D_B$, the angle of slope is changed from angle $\alpha_1$ to an angle $\alpha_2$ which is smaller than 90°.

To obtain, after fully winding the package, the end faces 23 and 22 shown in FIG. 2, the end face 23 is wound by the stroke function $F_1$, and the end face 22 by stroke function $F_2$. The variations of the traverse stroke over the diameter are shown in phantom lines. At the beginning of the winding cycle, the traverse stroke is adjusted to a maximum length $H_{An}$. As the winding progresses, the traverse stroke is initially reduced at both package ends in accordance with stroke functions $F_1$ and $F_2$. In the intermediate diameter range of the package, the traverse stroke is lengthened according to the stroke functions $F_1$ and $F_2$, until the length $H_{En}$ of the traverse stroke is reached at the end of the winding cycle.

The shortening and lengthening of the traverse stroke during the winding cycle are predetermined on both sides by the stroke functions $F_1$ and $F_2$, which lead to the desired shaping of the end faces, while taking into account the yarn parameters and the winding parameters. Basically, for producing as much as possible a straight line biconical or a straight line rectangular end face during the winding cycle, the traverse stroke variations are predetermined in such a manner that the yarn tension during the winding, the crimp of the yarn, the package density, as well as the yarn deposit result, by way of interaction, in the desired shaping of the end faces. The method of the present invention is characterized in that it purposely uses shape variations of the package for producing an optimal geometric form of the package.

Figure 3:
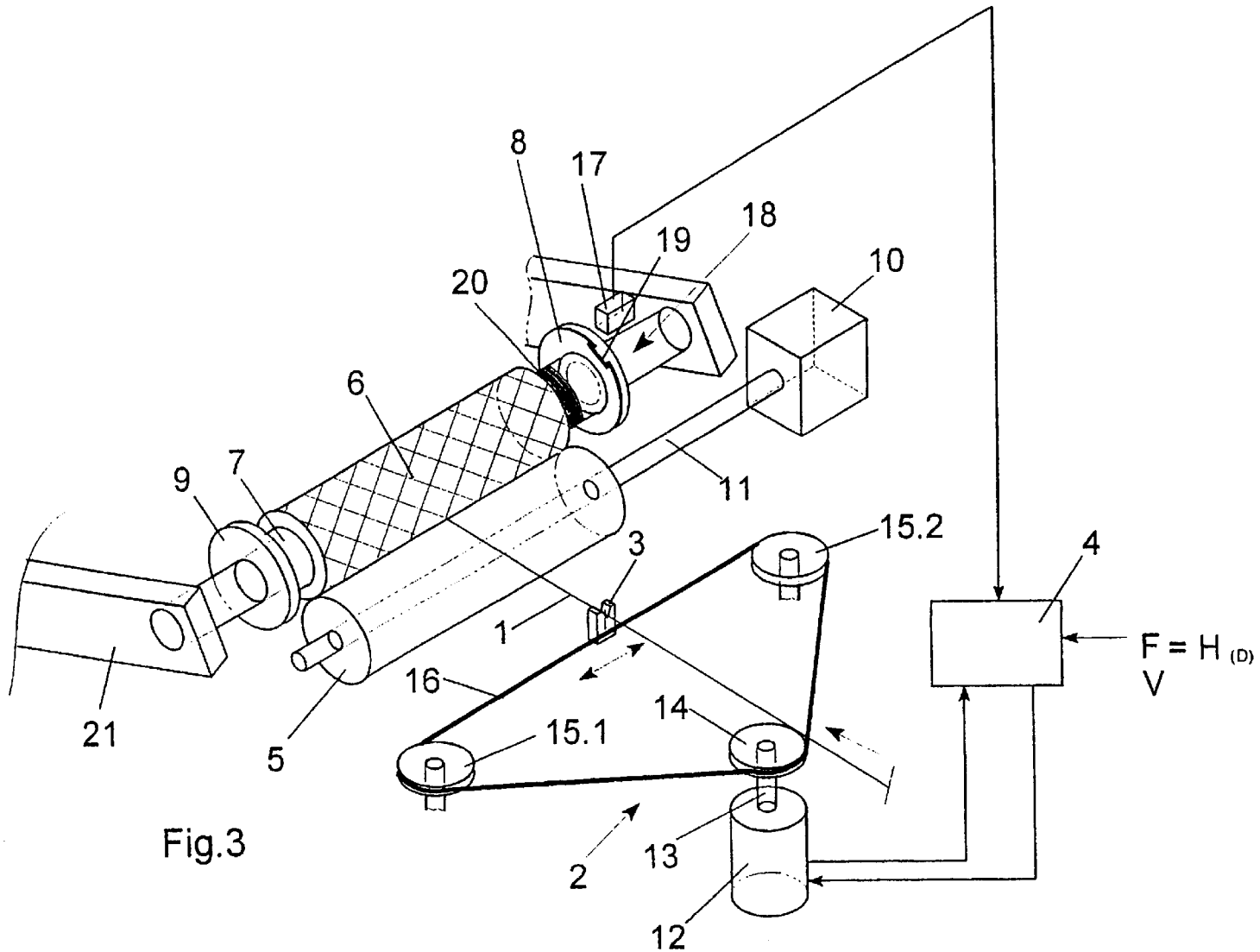
FIG. 3 is a schematic view of a device according to the invention for carrying out the method.

FIG. 3 illustrates an embodiment of a winding apparatus according to the invention, as may be used, for example, in a texturing machine. The free ends of a fork shaped package holder 21 mount for rotation two opposite centering plates 8 and 9. The package holder 21 is pivotally supported on a pivot axle (not shown) in a machine frame. Between the centering plates 8 and 9, a tube 7 is clamped for receiving a package 6. A drive roll 5 lies against the surface of tube 7 or package 6. The drive roll 5 is mounted on a drive shaft 11. The drive shaft 11 connects at its one end to a drive roll motor 10. The drive roll motor 10 drives the drive roll 5 at a substantially constant speed. Via friction, the tube 7 or package 6 is driven by drive roll 5 at a winding speed, which permits winding a yarn 1 at a substantially constant yarn speed. The winding speed remains constant during the winding cycle.

Upstream of drive roll 5, a yarn traversing device 2 is arranged. The yarn traversing device 2 is in the form of a so-called belt traversing system, wherein an endless belt 16 mounts a traversing yarn guide 3. The belt 16 extends between two belt pulleys 15.1 and 15.2 parallel to tube 7. In the belt plane, a drive pulley 14 partially looped by the belt is arranged parallel to the belt pulleys 15.1 and 15.2. The drive pulley 14 is mounted on a drive shaft 13 of a motor 12. The motor drives the drive pulley 14 for oscillating movement, so that the traversing yarn guide is reciprocated in the region between the belt pulleys 15.1 and 15.2. The motor 12 is controllable via a controller 4, which connects to a sensor 17 arranged on package holder 21. The sensor 17 measures the rotational speed of tube 7 and supplies it as a signal to controller 4.

In the present embodiment, the sensor 17 is in the form of a pulse transmitter, which senses a catching groove 19 in centering plate 8. The catching groove 19 forms part of a catching device 18, which engages the yarn 1 at the beginning of the winding cycle and facilitates the winding of the yarn on tube 7. In this process, the sensor 17 supplies for each revolution a signal as a function of the constantly returning catching groove 19. These pulses are converted in the controller for evaluating the position and the rotational speed of tube 7. The tube 7 is clamped between centering plates 8 and 9 such that the centering plates 8 and 9 rotate without slippage at the rotational speed of the tube.

In the situation shown in FIG. 3, a yarn 1 is first guided to form a yarn reserve 20 on the tube 7 and is then wound to the cross wound package 6 on tube 7. In this process, the yarn 1 is guided in a groove of traversing yarn guide 3. The traversing yarn guide is reciprocated by yarn traversing device 2 within the package width. In this process, the movement and the length of the traverse stroke are predetermined by motor 12, which could be realized, for example, as a stepping motor. The increasing diameter of cross wound package 6 is made possible by a pivoting movement of package holder 21. To this end, the package holder 21 includes biasing means (not shown), which generates on the one hand, between package 6 and drive roll 5, a contact pressure that is required for driving the package, and which enables on the other hand a pivoting movement of package holder 21.

Figure 4:
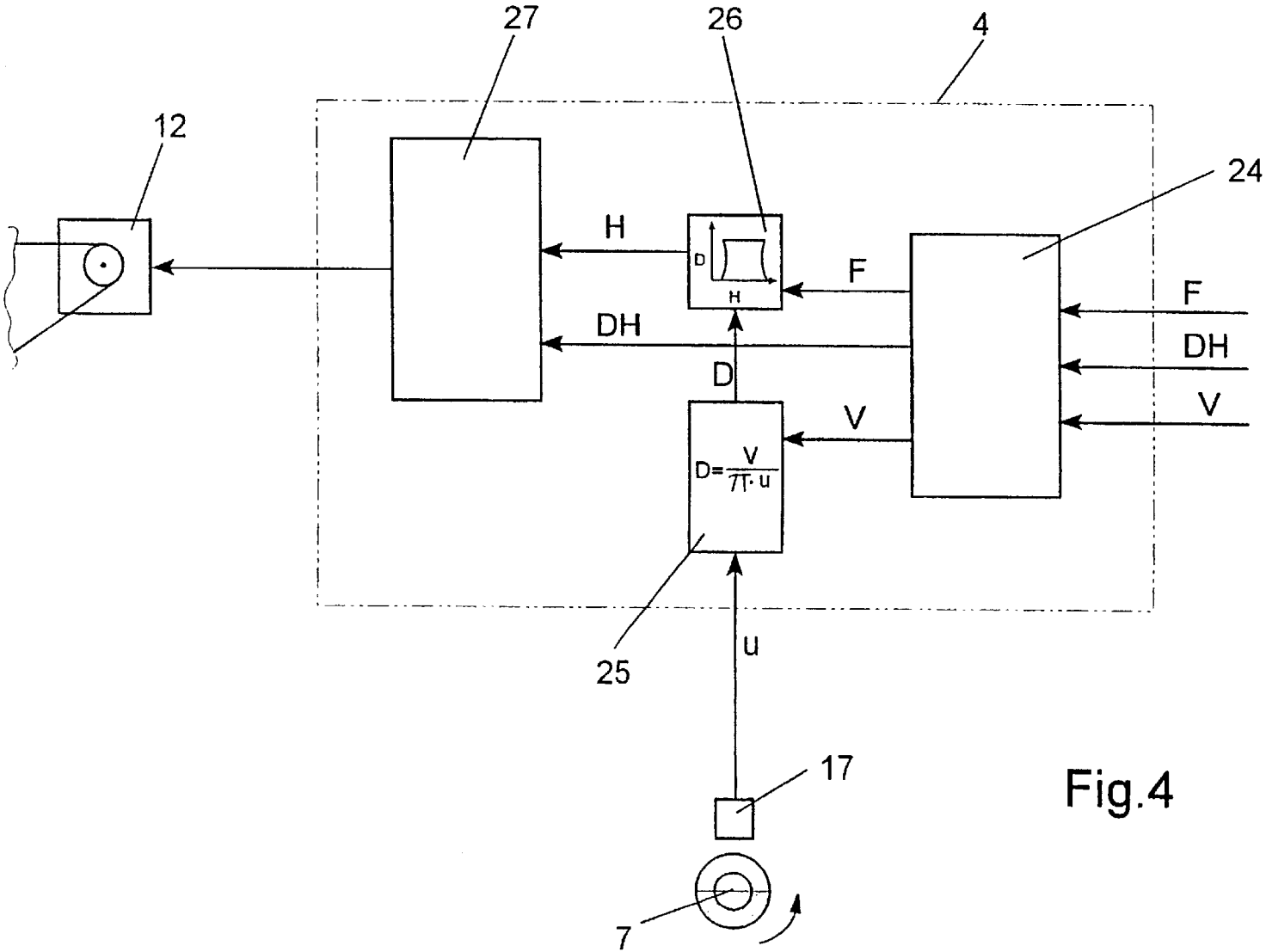
FIG. 4 is a schematic view of the controller of the device of FIG. 3.

Both the traversing speed of traversing yarn guide 3 and the length of the traverse stroke are predetermined by controller 4, which leads to a corresponding activation of motor 12. For the activation, the controller 4 receives the stroke function F as well as the winding speed V. As shown in FIG. 4, the controller 4 includes to this end a data storage 24. The data storage 24 stores not only the stroke function F and the winding speed, but also further control programs. In FIG. 4, the data storage 24 receives, for example, the traversing speed DH in the form of the number of double strokes per unit time. The controller 4 accommodates at least one computing unit 25, which continuously receives from the sensor 17, via a signaling line, the actual rotational speed u of tube 7. Subsequently, computing unit 25 determines from the winding speed V stored in data storage 24 and from the speed u, the respective instantaneous package diameter D with use of equation $D=v/(\pi \cdot u)$. The determined package diameter D and the stroke function F are supplied to a comparator 26, which determines the length of the traverse stroke associated to the instantaneous package diameter. This length of the traverse stroke H is then supplied to a control unit 27. The control unit 27 connects to motor 12 and performs a corresponding activation of the motor. At the same time, the control unit 27 predetermines the traversing speed or the control programs for the ribbon breaking or stroke modification steps. Such control programs may also be realized as a function of the respective package diameters.

The device of the present invention distinguishes itself by its high flexibility as well as a high precision in the winding of packages. This is accomplished in that at any time of the winding cycle, the instantaneous package diameter is known, and that thus a very exact control of the traverse stroke is made possible during the winding cycle.

What is claimed is:

1. A method of winding a continuously advancing yarn to form a cross wound package, comprising the steps of reciprocating the advancing yarn by means of a traversing yarn guide which defines a traverse stroke and so as to deposit the yarn on the package, controlling the traverse stroke of the traversing yarn guide within the package width so that at the beginning of the winding cycle the traverse stroke has a maximum predetermined length and at the end of the winding cycle the traverse stroke has a predetermined end length for defining a desired angle of slope of the end faces of the package, and wherein the length of the traverse stroke is varied as a function of a predetermined stroke function which associates in the course of the winding cycle a certain length to each traverse stroke, with the length of the traverse strokes within an intermediate range of the package diameter being less than the respectively final wound package widths.

2. The method of claim 1, wherein during the beginning portion of the winding cycle, the stroke function predetermines a continuous shortening of the traverse stroke relative to the final package width so that the difference between the length of the traverse stroke and the length of the final package width becomes progressively greater, and during the end portion of the winding cycle, a continuous lengthening of the traverse stroke relative to the final package width so that the difference between the length of the traverse stroke and the length of the final package width becomes progressively smaller.

3. The method of claim 2, wherein during the winding cycle, the stroke function associates to each instant of the winding cycle a certain length of the traverse stroke which is smaller in the intermediate diameter range of the cross wound package than the respectively resulting package width at the end of the winding cycle.

4. The method of claim 2, wherein during the winding cycle, the stroke function associates to each wound package diameter a certain length of the traverse stroke which is smaller in the intermediate diameter range of the cross wound package than the respectively resulting package width at the end of the winding cycle.

5. The method of claim 1, wherein the stroke function effects on both end faces of the cross wound package a symmetrical configuration.

6. The method of claim 1, wherein the stroke function effects on both end faces of the cross wound package an asymmetrical configuration.

7. The method of claim 1, wherein the stroke function is associated to each wound end diameter of the cross wound package, with the stroke function resulting in a certain angle of slope on at least one end face of the cross wound package.

8. The method of claim 1, wherein the stroke function is associated to each wound angle of slope of the cross wound package, with the stroke function resulting in a certain end diameter of the cross wound package.

9. The method of claim 1, wherein the maximum length and the end length of the traverse stroke are identical when the desired angle of slope is 90°, and wherein when the desired angle of slope is smaller than 90° the maximum length is greater than the end length of the traverse stroke.

10. The method of claim 1, wherein the traversing yarn guide is driven by a controllable drive which connects to a controller, and that the stroke function is stored in the controller.

11. The method of claim 10, wherein a rotational speed of package is measured and supplied to the controller, and the controller determines the instantaneous package diameter from the rotational speed of the package and the winding speed, so that the controller controls the drive with the length of the traverse stroke which is predetermined for the instantaneous package diameter.

12. The method of claim 1, wherein during the winding cycle, the traversing speed is varied by a predetermined control program.

13. The method of claim 1, wherein during the winding cycle, the traverse stroke is periodically varied by a predetermined stroke modification function.

14. An apparatus for winding a continuously advancing yarn to form a cross wound package, comprising a holder for rotatably mounting a tube on which an advancing yarn may be wound within a package width (B) to a cross wound package, a movable traversing yarn guide which is adapted for reciprocal movement along the tube by a traverse drive within a traverse stroke which is variable in its length, and a controller for controlling the traverse drive, with the controller connected to a sensor which measures the rotational speed of the tube and including a data storage for receiving at least one stroke function (F) and a winding speed (V), with the controller further comprising a computing unit for determining the instantaneous package diameter, and with the controller connected to the traverse drive of the traversing yarn guide to control the length of the traverse stroke, which is predetermined by the stroke function (F) and wherein the stroke function (F) is configured to coordinate the length of each traverse stroke so as to be smaller than the final wound package width then being formed, during at least an intermediate portion of the winding cycle.

15. The apparatus of claim 14, wherein the traverse drive of the traversing yarn guide is a stepping motor, which controls the traversing movement and the traverse stroke of the traversing yarn guide and which is activatable by the controller.

16. The apparatus of claim 15, wherein the motor comprises a drive pulley which drives a belt that advances over at least one belt pulley with the belt mounting the traversing yarn guide.

17. The apparatus of claim 14, wherein the holder comprises two centering plates arranged to clamp the tube therebetween, and the tube is driven by a drive roll in circumferential contact with the tube or package and with the sensor being arranged on the holder.

18. The apparatus of claim 17, wherein the sensor is a pulse transmitter which signals to the controller a revolution of one of the centering plates by a pulse, and that the controller comprises a counting unit which determines the rotational speed of the tube from the number of pulses per unit time.

19. The apparatus of claim 14, wherein the stroke function (F) is configured to cause a continuous shortening of the traverse strokes relative to the respectively wound package widths during the beginning portion of the winding cycle so that the difference between the length of the traverse stroke and the length of the final package width becomes progressively greater, and cause a continuous lengthening of the traverse strokes relative to the respectively wound package widths during the end portion of the winding cycle so that the difference between the length of the traverse stroke and the length of the final package width becomes progressively smaller.

* * * * *